United States Patent [19]

Kenly

[11] 3,974,656

[45] Aug. 17, 1976

[54] METHOD AND APPARATUS FOR EXCLUDING WATER OR OTHER MATERIAL FROM A BLAST HOLE IN ROCK

[76] Inventor: Donald F. Kenly, P.O. Box 174, Bearsville, N.Y. 12409

[22] Filed: Feb. 21, 1975

[21] Appl. No.: 551,737

[52] U.S. Cl. ..... 61/35; 86/20 C; 102/23

[51] Int. Cl.[2] ..... E02D 19/18; E42D 1/00

[58] Field of Search ..... 61/35, 53.52, 63, .5; 102/23; 86/20 C; 166/207, 315

[56] References Cited

UNITED STATES PATENTS

| | | | |
|---|---|---|---|
| 2,930,276 | 3/1960 | Smith et al. | 86/20 C |
| 3,199,399 | 8/1965 | Gardner | 86/20 C |
| 3,357,193 | 12/1967 | Fitzgibbon, Jr. | 61/35 |

FOREIGN PATENTS OR APPLICATIONS

| | | | |
|---|---|---|---|
| 1,087,061 | 8/1960 | Germany | 102/23 |

*Primary Examiner*—Jacob Shapiro
*Attorney, Agent, or Firm*—Ernest F. Marmorek

[57] ABSTRACT

A method and apparatus for excluding water and other materials from a blast hole in rock for extended periods of time by inserting an expandable sleeve into the hole; sealing the sleeve with a closure means including a plug disposed in the sleeve, which closure means acts to exert increasing pressure between the plug and the wall to thereby seal the sleeve against the plug; and expanding the sleeve through an inlet conduit in the closure using compressed gas.

12 Claims, 7 Drawing Figures

METHOD AND APPARATUS FOR EXCLUDING WATER OR OTHER MATERIAL FROM A BLAST HOLE IN ROCK

BACKGROUND OF THE INVENTION

The invention relates to a method and apparatus for excluding water and other materials for extended periods of time from blast holes in rock. This is particularly useful when blast holes are made but must be left unused for an extended period of time. If water is permitted to seep into the hole, certain blasting agents, such as ammonium nitrate cannot be used. These blasting agents tends to be degraded or otherwise unusable under wet conditions. Water resistant high explosives tend to be considerably more expensive and are therefore less preferred for use under conditions where the less expensive explosives will work.

Heretofore, drilled blast holes have been prepared by drilling rock to depths greater than 100 feet, and charged with cartridge explosives and/or other blasting agents, i.e. ANFO (ammonium nitrate) or NCN (nitro carbon nitrate) where conditions permitted. Certain problems confronted the normal procedure as follows:

After the holes were drilled, they would substantially fill with water or other foreign material via surface conditions, rain or wind, or water seepage in the rock fissures. Also, hydrostatic water pressure would vent through drilled blast holes.

Previous methods used to overcome these problems include pumping or bailing the hole prior to loading with explosives. In most cases, however, the water would seep in too quickly to permit use of water-sensitive blasting agents as an inexpensive explosive charge. Thus, only water-resistant high explosives could be used to overcome these water conditions which, as noted above, caused a substantial cost increase (approximately three times increase in the cost of the blasting agents).

One previous method described in patents to Smith et al., Ser. No. 2,930,276 and to Aitchison et al., Ser. No. 2,745,346, teaches the use of an elongated, inflatable, impervious tube which is first inserted into a hole, inflated with an inert gas, and charged with the liquid oxygen type of blasting material. The prime object of this art was to provide a method of charging blast holes with explosives of the liquid oxygen type. Another claim of these prior art teachings was to solve the water seepage problem during or after charging the explosives, by first inflating the tube and thereby displacing the water prior to charging. While these methods claim to displace water, as will be shown below, they are inadequate to do so or to be effective for an extended period of time. Neither of these references appear to teach that the sleeve will be effective over an extended period of time but rather appear to teach filling the sleeve with appropriate explosives soon after it has been inserted and inflated.

SUMMARY OF THE INVENTION

It is therefore one of the principle objects of the instant invention to teach a method and apparatus for eliminating water and other material and to prevent, for extended periods, their seepage into holes drilled in rock.

It is a further object to provide a method and apparatus to permit drilling blast holes in advance of the time when they are to be filled, and to permit such subsequent use of the blast holes with blasting agents which may be degraded by the presence of water, but which are less expensive than water impervious blasting agents.

Further objects and advantages of the invention will be set forth in the following specification and in part will be obvious therefrom without being specifically referred to, the same being realized and attained as pointed out in the claims hereof.

Other objects of the invention will in part be obvious and will in part appear hereinafter.

With the above and other objects of invention in view, the invention consists in the novel methods; and the novel construction, arrangement and combination of various devices, elements and parts, as set forth in the claims hereof, certain embodiments of the same being illustrated in the accompanying drawings and described in the specification.

The invention accordingly comprises the features of construction, combination of elements and arrangements of parts which will be exemplified in the construction hereinafter set forth, as well as the several steps in the relation of one or more such steps with respect to each of the others, all as exemplified in the following detailed disclosure, and the scope of the application of which will be indicated in the claims.

In the following description and claims, the terms top and bottom or upper and lower are used for convenience only and are intended to designate the open and of the hole or apparatus associated with the open end of the hole, as the top or upper part while the opposite end of the hole and that apparatus associated therewith is intended to be designated as the bottom or lower portion.

BRIEF DESCRIPTION OF THE DRAWINGS

The invention will become more readily apparent from the following description of preferred embodiments thereof shown in the accompanying drawings, in which.

DESCRIPTION OF THE PREFERRED EMBODIMENTS

Figures 1, 2, 3, 4, 5:
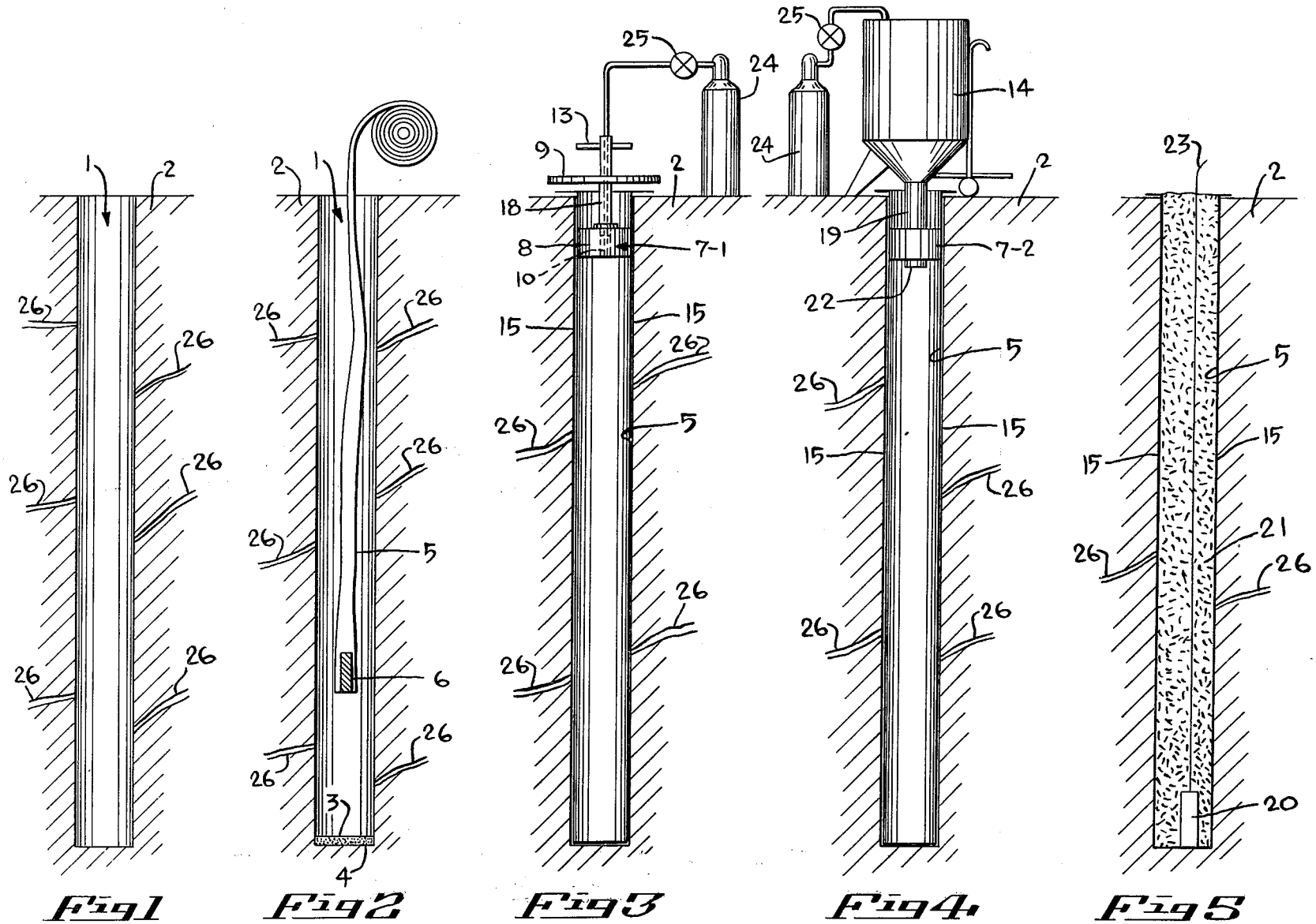
FIG. 1 shows a hole which has been bored in the earth for use as a blast hole.
FIG. 2 shows the hole with an expandable sleeve being lowered thereinto.
FIG. 3 shows the sealing closure in place and the expandable sleeve inflated against the sides of the hole.
FIG. 4 shows an embodiment in which pressure must be maintained in the inflated expandable sleeve to exclude water from the hole even while filling, the dispenser is shown in place with an appropriate sealing closure.
FIG. 5 shows the blast hole filled with blasting agent, a detonator, and stemming material.

In carrying the invention into effect in the embodiments which have been selected for illustration in the accompanying drawings and for description in the specification, and referring now to FIGS. 1 to 7, a hole 1 is provided in rock 2, using any known method, for example, being bored in the earth. In the preferred embodiment, a layer of sand 3 as shown in FIG. 2 is disposed on the bottom 4 of the hole 1. The expandable sleeve 5, preferably of 6 mil polyethylene, is inserted into the hole 1, preferably with the aid of weight 6 disposed within the sleeve (FIG. 2).

Figure 6:
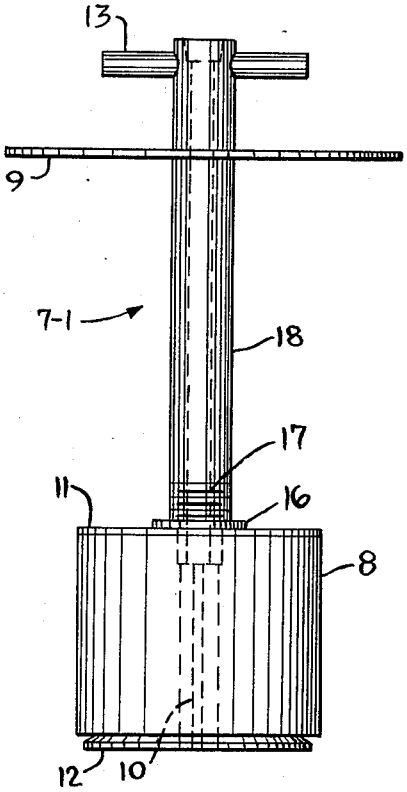
FIG. 6 shows a detail of FIG. 3 illustrating in section, a preferred sealing closure.

In the preferred embodiment, a sealing closure 7-1, as shown in FIG. 6, comprising an expansion plug 8, is disposed within the sleeve 5 and below the top of the hole 1, as shown in FIG. 3. A stop plate 9 may be used to locate and hold the expansion plug at a predetermined level below the top of the hole until the expansion plug 8 is expanded against the walls 15 of the hole 1.

As shown in detail in FIG. 6, the sealing closure 7 also comprises a gas passage or inlet conduit 10 through which compressed gas may flow into the sealed sleeve (FIG. 3). The expansion plug 8 is expanded, for example, by compressing the plug 8 between an upper and a lower compressing plate (11,12), the plates (11,12) being pressed together by the action of a compressing washer 16 riding on threads 17 disposed on a shaft 18 on which the expansion plug 8 is also disposed. A handle 13 may be provided for operating the sealing closure 7-1 by rotating the shaft 18.

Once the sleeve 5 has been inflated against the walls 15 of the bore hole 1, it may be maintained thusly by the gas pressure contained within the flexible sleeve 5 until ready to be filled as shown in FIG. 5 with appropriate materials such as a detonator 20, blasting agent 21 and stemming material. The sealing closure 7-1 may then be removed and the hole filled.

In the case of a hole into which water seepage, for example through rock fissures 26, is too fast to allow the hole 1 to be packed or filled before the sleeve 5 collapses from the water seepage pressure, a dispenser 14 operating through a connecting tube 15 can be used to fill the sleeve through gas passage 10 while maintaining the pressure within the sleeve 5, as shown in FIG. 4. A filling closure 7-2 is inserted in place of sealing closure 7-1, which filling closure 7-2 permits maintaining gas pressure while filling.

FIG. 5, as noted above, shows a hole filled and readt for detonation. (Lead wires 23 permit detonation).

OPERATION

The operation of the above described embodiments of the invention is as follows:

An important feature of the operation of the instant invention is the location of the sealing closure 7-1 in the upper end of the expandable sleeve 5, but below the top of the hole. Thus, the pressure of the inflating gas presses expandable sleeve 5 against the walls 15 of the hole. The walls 15 of the hole 1 therefore reinforce the expandable sleeve 5 and permit it to be made out of lighter, less expensive material which would not otherwise be able to contain the pressure.

As is known in the art, in theory it requires 0.434 lbs. per sq. inch of pressure to displace water one foot in depth. Therefore, in the case of a 50 foot hole, 21.7 lbs. per sq. inch of pressure would be required to displace water. In repeated tests, using convenient polyethylene sleeves, the maximum pressure that a 6 mil polyethylene tube or sleeve was found capable of containing is 2 lbs. per sq. inch of pressure, and that only for a short period of time. Two lbs. per sq. inch of pressure is only capable of displacing about 0.868 feet of water. When following the teaching of the instant invention, on the other hand, in one test using a 21 foot deep bore hole and inflating the sleeve with 75 lbs. per sq. inch of pressure, the sleeve maintained the bore hole in usable condition for a period of at least two weeks. Thus, an object of the instant invention is easily attained and with the use only of a polyethylene tube or sleeve which would not otherwise be able to support the required pressure. The prior art references noted above appear to teach sealing an insert or sleeve above the level of the hole, thus requiring the top of the insert to support the inflation pressure without reinforcement, this ability to contain the gas pressure is limited in magnitude and in time by the insert characteristics. The instant teachings permit the use of relatively light and inexpensive polyethylene tubes, without further reinforcement.

As shown in FIG. 2, a weight 6 is disposed within the expandable sleeve 5, representing an additional improvement over the prior art method shown in the above noted references. Those prior art teachings show the weight being disposed on the bottom or outside of the inflatable part of the sealed sleeve, thereby leaving the possibility of unsupported areas of the sleeve at the bottom. This can result in breaking of the sleeve due to either the inflation gas pressure or the weight of the material to be packed in the sleeve. In the instant invention, no such pocket is formed at the bottom to the weight location. As a further improvement, sand 3 may be disposed at the bottom of the hole as shown in FIG. 2, which acts as a cushion.

The provision for the inlet conduit or gas passage 10 through the expansion plug sealing closure 7-1 is required to permit the inflation of the expandable sleeve, as noted above. Under conditions of slow seepage, the sealing closure 7-1 can be removed and the hole filled without special provision for maintaining the pressure.

Figure 7:
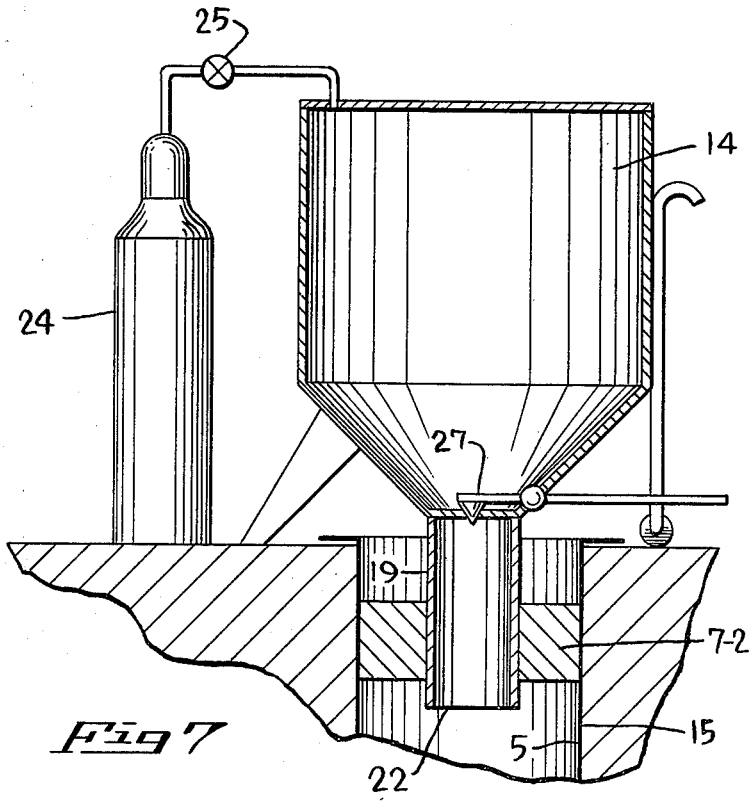
FIG. 7 shows a detail of FIG. 4 illustrating in section, a filling device and closure for packing the hole while maintaining gas pressure.

Under conditions where water seepage is so rapid that there is not time to fill the sleeve before it collapses, thus requiring maintenance of pressure during filling, an arrangement, as shown in FIGS. 4 and 7, provides for maintaining inflation of the expandable sleeve through a dispenser 14 and a connecting tube 19 connected to a filling conduit 22, through filling closure 7-2, in a known manner. This apparatus may be attached at a time subsequent to the expansion and sealing of the sleeve 5, by removing sealing closure 7-1 and inserting in its place, filling closure 7-2. A free-flowing blasting agent or other material should be used to permit the material to enter the blast hole through the opening in the dispenser, by means of gravity. Once the hole is filled, the gas pressure may, in any case, be released. Any of the well-known filling closures 7-2 may be used for th packing of the blast hole, in conjunction with known dispensers.

In essence, the dispenser 14 and the expandable sleeve 5 are maintained at the same predetermined pressure by means of a compressed gas source 24 operating preferably through a regulator 25. Once gas pressure equilibrium is attained, a hand operated or other valve 27 may be opened and a flowable type packing will flow into the sleeve by action of gravity.

Although it is preferable to utilize the instant method and apparatus as soon as possible after the hole is bored to prevent the initial seepage of water through rock fissures, for example, or the entry of surface water and/or silt and other materials into the bore hole 1, as noted above, sufficient pressure to subsequently exclude these materials can be applied to the sleeve 5. Once the sleeve 5 has been sealed with the sealing closures 7-1 and inflated therethrough, it will maintain the hole in usable condition for as long as the air pressure is maintained at a sufficient level to prevent tube collapse. In this way, surface water and other deleterious materials would be excluded from the bore hole by the very nature of the closure plug 8 plugging the top of the bore hole and seepage of water is prevented by the pressure of the gas contained in the sleeve with the aid of the walls of the hole.

I wish it to be understood that I do not desire to be limited to the exact details of construction shown and described, for obvious modifications will occur to the person skilled in the art.

Having thus described the invention, what I claim as new and desire to be secured by Letters Patent, is as follows:

1. A method for excluding water or other material from a blast hole in rock for an extended period of time, for example to permit subsequent loading of blasting agents which might otherwise be degraded by the presence of water, comprising the steps of inserting an expandable sleeve means into the hole, said sleeve means being closed at the lower end inserted into the hole;

thereafter sealing the upper end of the sleeve by exerting outwardly directed pressure from inside said sleeve towards the wall of the hole to seal the upper end of the sleeve inside and against the wall, and forcing compressed gas to pass through said seal into said sleeve and retaining said gas under predetermined pressure within said sleeve, the sides of said hole.

2. A method as claimed in claim 1 further comprising the steps of disposing a layer of sand or similar material on the bottom of the hole before the sleeve is inserted, to cushion the sleeve.

3. A method as claimed in claim 1, further comprising the steps of disposing a weight in said sleeve to aid in lowering the lower end to the bottom of the hole.

4. A method as claimed in claim 1 whereby the upper end of the sleeve is sealed by disposing a closure means comprising an expansion plug within the sleeve and within the hole; and expanding said plug inside the sleeve in a direction against the walls of the hole.

5. A method as claimed in claim 4, further comprising the steps of removing said closure means; and thereafter filling said sleeve with whatever material is desired.

6. A method as claimed in claim 1 wherein there is provided a filling closure means for sealing said sleeve, including a filling conduit operable to permit inflating and filling of said sleeve, the further steps of:

removing said seal from the upper end of the sleeve, normally causing partial deflation of the sleeve;

inserting said filling closure means into said sleeve in place of said seal;

re-inflating the sleeve through said filling closure means; and thereafter filling said sleeve through said filling conduit with whatever free-flowing material is desired.

7. An apparatus for excluding water or other material from a blast hole in rock, for an extended period of time, for example, to permit subsequent loading of blasting agents which might otherwise be degraded by the presence of water, comprising an expandable sleeve of suitable dimension to line the hole and having an upper and lower end, the lower end of said sleeve, which is to be inserted into the bottom of the hole, being sealed;

means operable for lowering the lower end to the bottom of the hole;

a closure means including a plug, and operable to exert increasing pressure between the plug and the wall of the hole, to seal said sleeve against the plug, the closure further including an inlet conduit operable to permit compressed gas to pass therethrough and be retained under pressure within said sleeve.

8. An apparatus as claimed in claim 7, wherein said sleeve is composed of polyethylene without additional suppport means.

9. An apparatus as claimed in claim 7, wherein said closure means is an expansion plug.

10. An apparatus as claimed in claim 7, further including a weight disposed inside and at the lower end of said sleeve, to aid in lowering the lower end of said sleeve to the bottom of the hole.

11. An apparatus as claimed in claim 7, wherein said sleeve is composed of polyethylene without additional support means, and said closure means comprises an expansion plug.

12. An apparatus as claimed in claim 7, further including a closing device comprising a filling conduit operable to permit inflating the expandable sleeve and thereafter filling said sleeve with flowable material, said closing device being operable to replace said closure means in said expandable sleeve.

* * * * *